United States Patent [19]

Datseris et al.

[11] Patent Number: 4,769,884

[45] Date of Patent: Sep. 13, 1988

[54] ROBOTIC APPARATUS FOR AUTOMATICALLY ASSEMBLING CHAINS

[76] Inventors: Philip Datseris, 33 Linden Dr., Kingston, R.I. 02881; Albert F. Wiesner, III, 60 Sherman Farm Rd., Harrisville, R.I. 02830

[21] Appl. No.: 937,099

[22] Filed: Dec. 2, 1986

[51] Int. Cl.[4] ..... B23P 23/04

[52] U.S. Cl. ..... 29/33 K; 29/428; 29/160.6; 29/33 R; 29/564.8; 59/16; 59/31; 228/192; 901/41; 901/42

[58] Field of Search ..... 59/16, 12, 35.1, 93, 59/31; 29/428, 160.6, 33 K, 33 R, 564.6, 564.8; 401/41, 42; 228/5.1, 13, 192

[56] References Cited

U.S. PATENT DOCUMENTS

| | | | |
|---|---|---|---|
| 3,701,251 | 10/1972 | Andreasson et al. | 59/16 |
| 3,945,198 | 3/1976 | Linden et al. | 59/16 |
| 3,977,180 | 8/1976 | Booth | 59/16 |
| 4,141,211 | 2/1979 | Svensson et al. | 59/16 |
| 4,298,154 | 11/1981 | De Fusco | 29/160.6 |
| 4,569,472 | 2/1986 | Zettl | 228/192 |

*Primary Examiner*—David Jones

*Attorney, Agent, or Firm*—Samules, Gauthier, Stevens & Kehoe

[57] ABSTRACT

A robotic chain assembly which uses two clamps, a robot gripper and a computer with auxiliary stations. The assembly both measures and cuts the chain, secures fasteners to the ends of the chain and secures the fasteners one to the other.

16 Claims, 10 Drawing Sheets

ROBOTIC APPARATUS FOR AUTOMATICALLY ASSEMBLING CHAINS

BACKGROUND AND BRIEF SUMMARY OF THE INVENTION

This invention relates to an apparatus and method for assembling components of elongated jewelry articles such as chains.

In the assembly of such chains, the chain is initially cut to length and end caps or D-rings are secured to the ends by welding or soldering. These steps are typically accomplished by hand although it is known to automatically weld D-rings to the ends of such chains. See for example U.S. Pat. No. 4,298,154. Subsequently, a spring ring is secured to one of the ends or rings whereby the chain may be opened and closed. Typically, a quality tag is secured to a D-ring. When the quality tag is secured to such a ring, the ring is typically a split ring which is opened and then closed. Further, the spring ring has a split bail which is opened and threaded through the end cap, or D-ring or quality tag and then closed. These steps are normally performed by hand.

The present invention is directed to an apparatus wherein a chain is taken from a spool, measured and cut. Clamps engage and transport the ends of the chain to an assembly station where fasteners such as end caps or D-rings are soldered onto the ends of the chain. The bail of a spring ring is opened, passed through the one D-ring or end cap and closed. A quality tag may or may not be added as a step in the assembly. Lastly, the spring ring is opened and secured to the other D-ring or end cap and thus the chain is closed and placed on a rod or the like. These steps are all programmed and performed automatically.

The assembly station is defined generally as including the soldering platform, the various fastener feeders (as will be described), a ring twisting station and a robot arm. The apparatus can assemble chains employing any type of 'fastener' including but not limited to rings, O-rings, quality tags, spring rings, caps, fish-hooks, lobster claws and sister hooks which are now available.

The invention broadly embodies a robotic system and method of using that system. In one aspect of the invention, three robotic hands or grippers are used in combination to assemble a product.

In its preferred embodiment, the invention is used for measuring chain lengths, securing fasteners to the ends of the chain and securing the fasteners to one another. In one aspect of the preferred embodiment, a chain length may be measured and cut at a predetermined length, which length exceeds the distance that a gripper(s) engaging the chain can physically travel. That is, a chain can be measured and cut at a length which exceeds the structural dimensions of the system.

In another aspect of the invention, feeders for fasteners are provided which select a fastener out of a random array of fasteners, move the fastener to a predetermined position (known orientation) whereby the fastener may be acquired by a robotic gripper for assembly to a chain or other fastener.

In a further aspect of the invention, a structure and method are provided for physically securing the fasteners to the chain and to one another.

In a still further aspect of the invention, the three robotic grippers are used to secure the ends of the chain one to the other thereby forming a closed loop.

In a particularly preferred embodiment, the invention comprises an apparatus for securing fasteners to the ends of a chain wherein a shearing station is disposed at one end of an elongated housing and an assembly station is disposed at the other end of the housing. At least two clamps are provided, a first clamp to engage one end of the chain and a second clamp to engage the other end of the chain. The clamps are adapted to move the chain between the shearing station and the assembly station. Further, control means are provided to effect the relative movement of the clamps, securing of fasteners to the chains and the securing of the fasteners one to the other.

The method of the invention comprises clamping one end of a chain, forming a second end of the chain, clamping the second end of the chain and moving one of said ends to an assembly station to secure a fastener to said end, and the two finished ends of the chain are attached to form a closed loop (chain).

DESCRIPTION OF THE PREFERRED EMBODIMENT(S)

Figure 1:
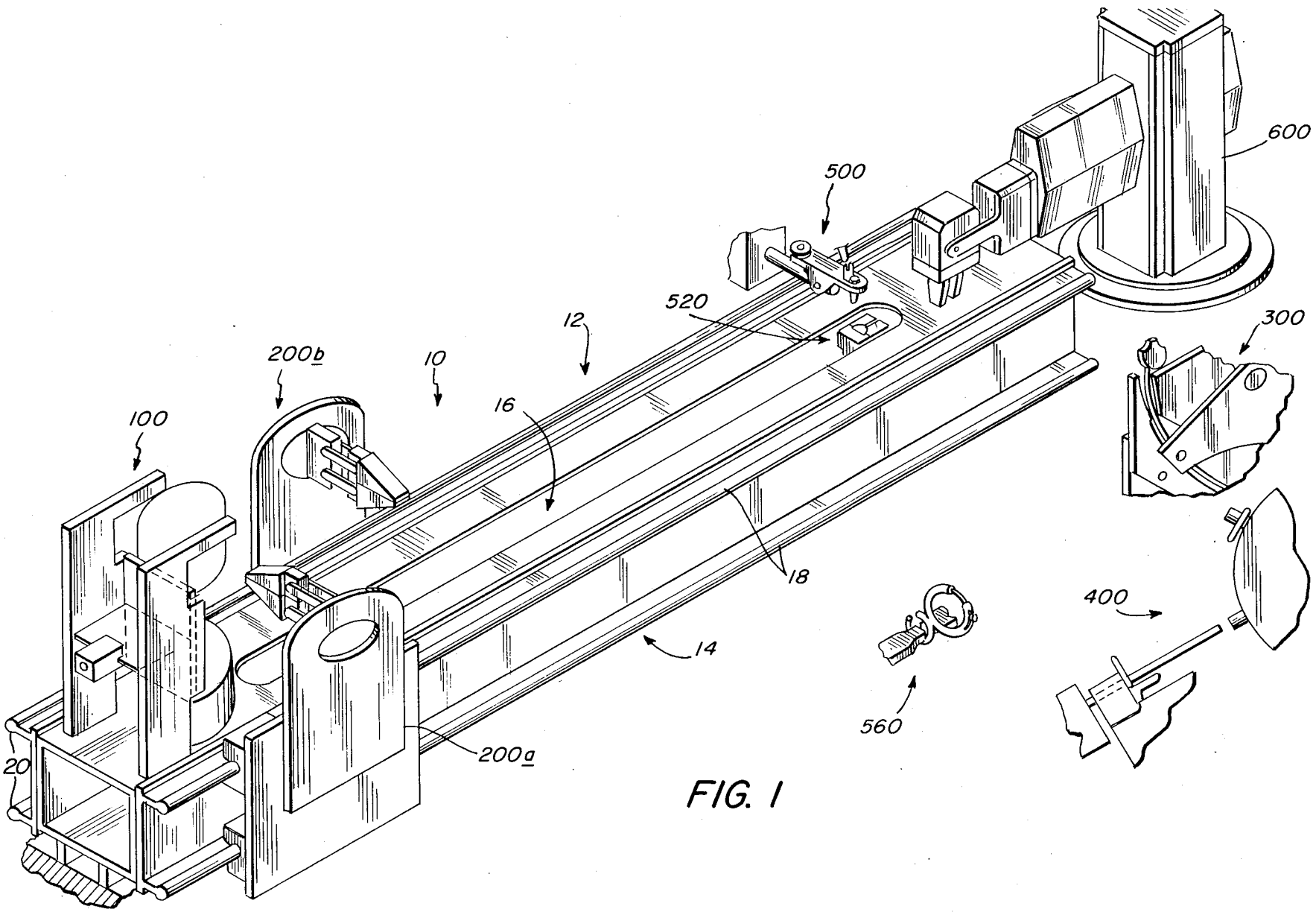
FIG. 1 is a perspective view of a robotic assembly of the preferred embodiment of the invention.

Referring to FIG. 1, a robotic assembly apparatus is shown generally at 10 and includes an elongated box-like housing 12 to which is joined a shearing station 100 at one end and opposed gripper assemblies 200*a* and 200*b*. An assembly station and a robot arm 600 are disposed at the other end. The assembly station comprises an end cap feeder 300, a spring ring feeder 400, a welding arm 500, a soldering platform 520 and a ring twisting station 560.

The components shown in FIG. 1 are the components used for assembling the chain of the preferred embodiment. The elongated box-like housing includes an upper plate 14 characterized by an elongated slot 16. Paired rails 18 are secured to one side thereof and paired rails 20 are secured to the other side thereof. The housing 12 is secured to a base plate 24 by legs 26, see FIG. 4; and secured to each side of the housing 12 is a rack 28.

Figure 3:
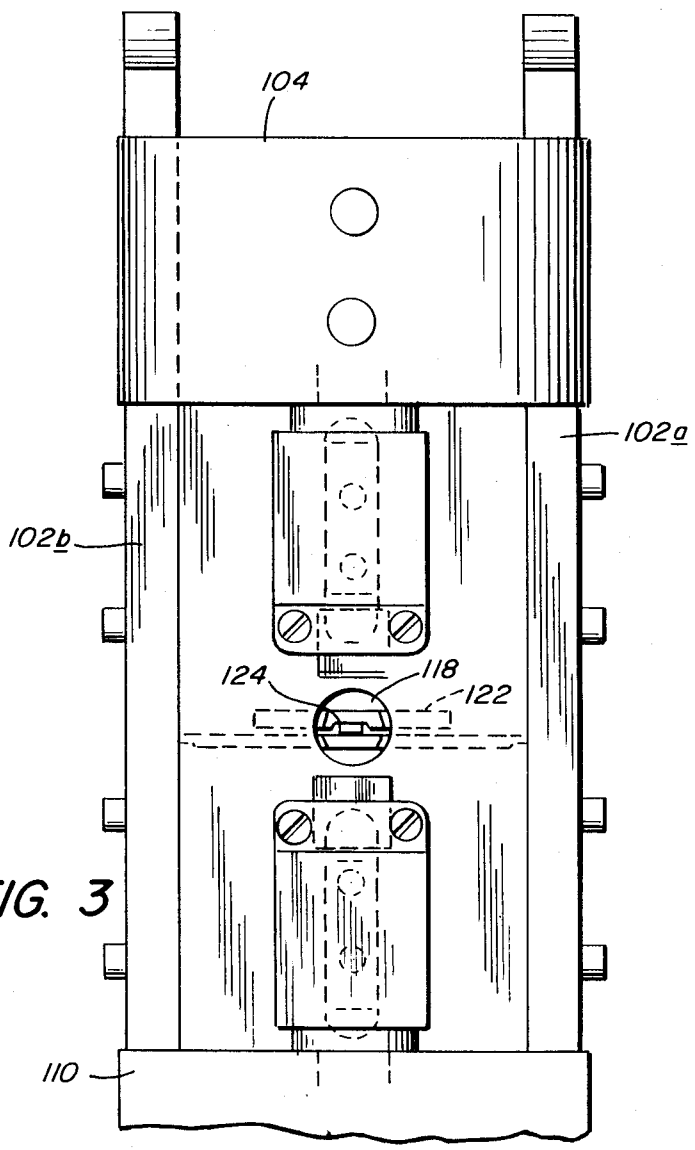
FIG. 3 is a front view of FIG. 2.
Figure 2:
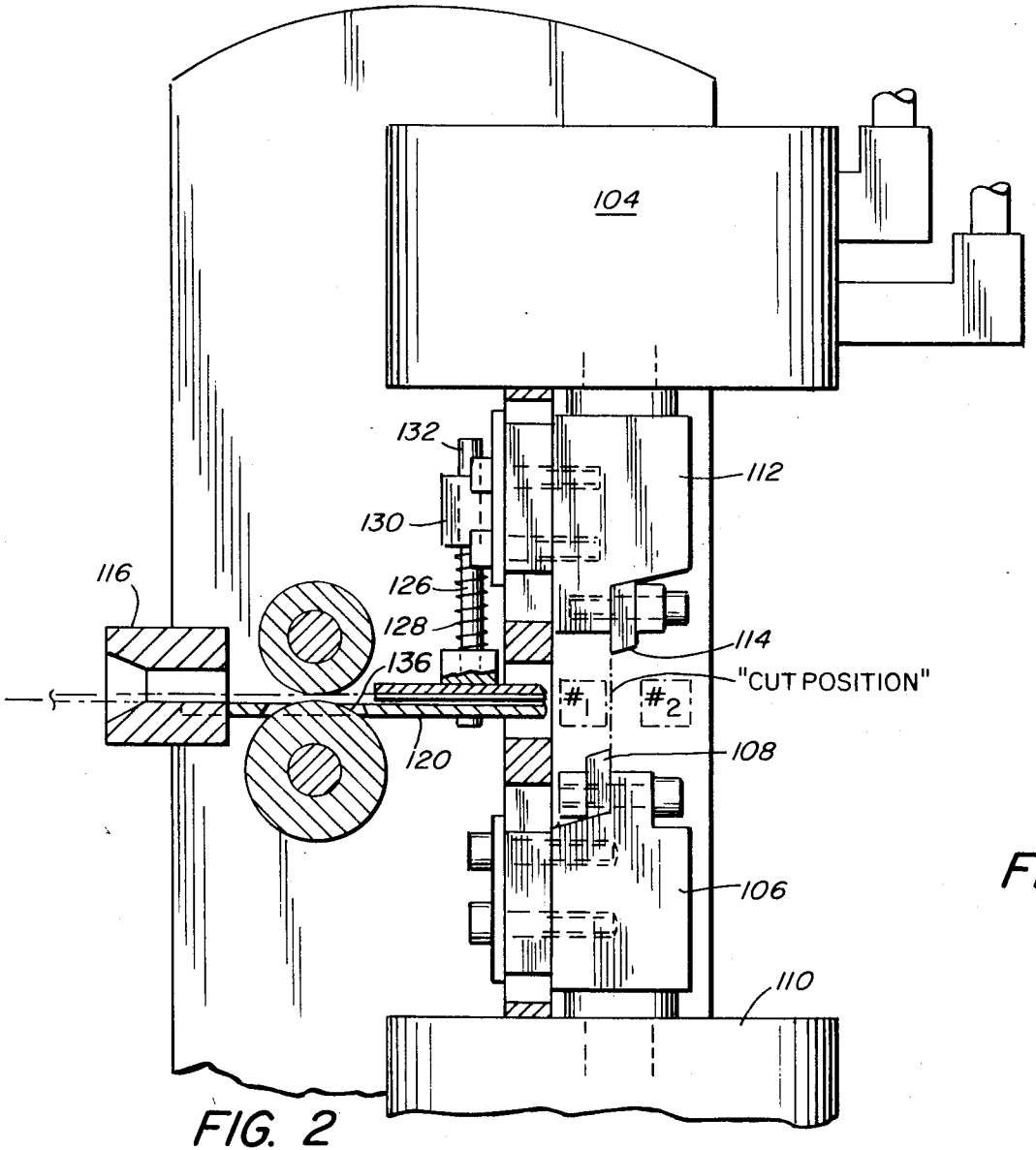
FIG. 2 is a side view of a shearing station.

Referring to FIGS. 2 and 3, the shearing station 100 comprises sides 102*a* and 102*b*, an upper pneumatic cylinder 104 and a lower pneumatic cylinder 110. The sides are secured to the top plate of the housing, see FIG. 1, and the cylinders are secured to the sides. The lower cylinder includes a ram 106 terminating in a knife 108. The upper cylinder includes a ram 112 terminating in a knife 114. The knives 108 and 114 are positioned in a scissor-like relationship. A chain is fed through a passageway 116, of a guide member 118 and carried on a support plate 120. To maintain the chain aligned and in a flat position, a foot plate 122 engages the chain and the foot plate 122 is characterized by a recess 124 through which the chain travels. The foot plate 122 is secured to a shaft 126 which in turn is secured to an anchor plate 130. The foot plate is slidably received on the shaft 126 and is biased downwardly by a spring 128. The tension on the plate 122 may be varied by adjusting the tensioning nut 132. Pressure nip rolls 134 keep the chain taut while it is drawn from a spool (not shown) and before and after it is cut. The lower nip roll is received in an opening 136 in the plate 120. The pressure of the nip rolls on the chain is adjustabale by springs and an adjusting screw assembly (not shown).

As shown more clearly in FIG. 1, the openings in the sides 102*a* and 102*b* are to accommodate the movement of the gripper assemblies 200*a* and 200*b*.

Figure 4:
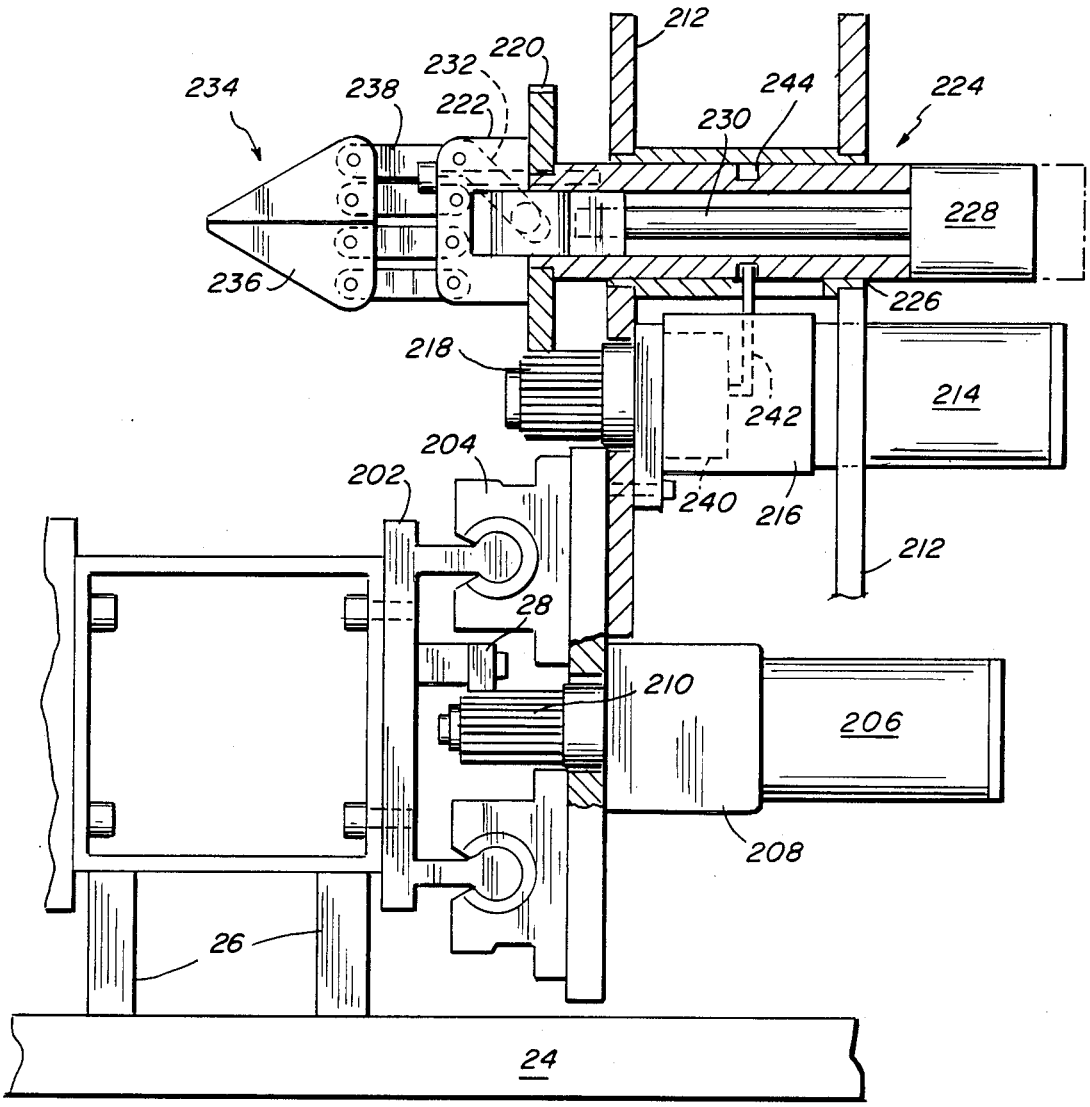
FIG. 4 is a side view of a gripper assembly.

Only one gripper will be described in detail both grippers being identical. Referring to FIG. 4, a plate 202 supports two carriage assemblies 204 which ride on the rails 18. A motor 206 is joined to a gear box 208 which drives a pinion gear 210 which engages the rack 28.

Supports 212 carry a motor 214 and gear box 216 which drives a pinion 218. This pinion 218 engages a spur gear 220 which is secured to a trunnion 222. The supports further carry an assembly 224 which is adapted for movement between a first and a second position in a bearing sleeve 226, as shown on the dotted lines.

The assembly 224 comprises an inner cylinder 228 having a ram 230 which connects to a parallel linkage 232. A clamp 234 has parallel jaws 236 which are pinned to actuating levers 238. The assembly 224 is itself moved reciprocally in the sleeve 226 by a pneumatic cylinder 240 attached to supports 212. Cylinder 240, in dotted lines, actuates a lever 242 which passes through a longitudinal slot (not shown) in the sleeve 226 and provides reciprocal movement of the assembly 224. The lever 242 is received in a groove 244 of the cylinder 228 which also allows for rotation of assembly 224 about its longitudinal axis.

Figure 5:
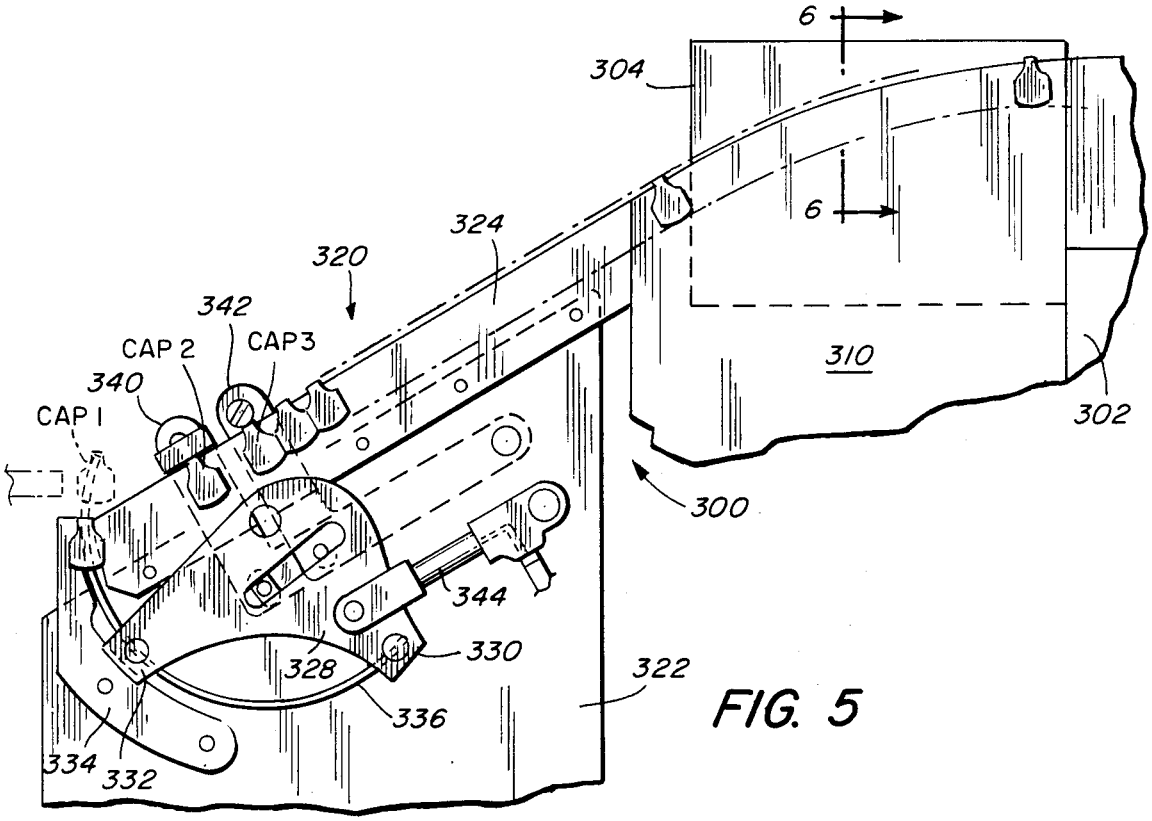
FIG. 5 is a side view of an end cap feeder.
Figure 6:
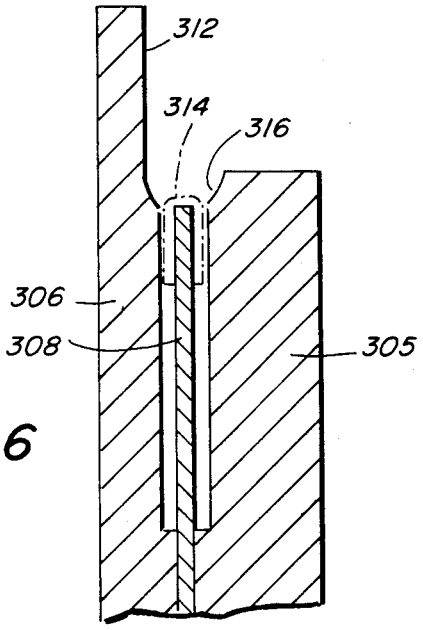
FIG. 6 is a view of FIG. 5 taken along lines 6—6 of FIG. 5.

The end cap feeder, FIGS. 5 and 6, is shown generally at 300 and receive end caps from a standard vibration bowl feeder 302. Adjacent to the outlet of the bowl feeder is an alignment chute 304 shown in greater detail in FIG. 5. The chute 304 comprises opposed walls 305 and 306. Interposed between these walls and spaced apart from their inner surfaces and in parallel alignment therewith is a blade 308. The walls 305 and 306 are bolted one to the other thereby clamping the blade 308 between them. The alignment chute is secured to a support block 310. The wall 306 includes an upper extension 312 which causes an end cap 314 to deflect and fall into the V-shape troth 316 which is defined by the opposed beveled upper edges of the walls 305 and 306. The end cap by gravity will move downwardly such that it is carried on the blade 308 in saddle-like fashion. The end cap will descend by gravity down the blade 308 where it is transferred to an orientation station 320.

The orientation station comprises a base 322 having a blade 324 secured to its upper edge. The blade 324 is axially aligned with the blade 308 such that the end caps will slide from the blade 308 to the blade 324 and continue their travel downwardly. Although a specific angular orientation is shown in the drawings, any orientation or structure which would ensure movement of the end caps to the end of the blade 324 may be used. A bell crank 328 is rotatably pinned to the base 322. The crank includes arms 330 and 332. A guide plate 334 is secured to the base 322 and spaced apart from the crank 328. The crank carries an arcuate wire 336 secured to the arms 330 and 332 which extends beyond the arm 332 and into a passageway defined by the upper portion of the guide plate 334 and the depending end of the blade 324.

Positioning plates 340 and 342 are reciprocally mounted at their lower ends in the base 322. A cylinder 344 actuates the crank causing the end of the wire 336 to move upwardly carrying an end cap with it. The end cap, as shown, straddles both the guide plate 334 and the blade 324. It clears the blade and still slightly straddles the guide plate 334 in its uppermost position as shown in dotted lines. This ensures stability while the robot gripper (shown on dotted lines) advances and grasps the end cap and transfers it to the soldering platform. The cylinder 344 retracts withdrawing the wire allowing the next succeeding end cap to slide under 340 which presses on the cap.

When cylinder 344 is extended, cap 1 is lifted for acquisition by robot gripper while plate 340 lifts to allow cap 2 to slide down the blade where it comes into contact with the wire and cap 3 is still under element 342. When cylinder 344 is retracted, cap 2 goes over the wire, 342 lifts to allow cap 3 to slide under 340 and then plate 340 comes down on cap 3. This completes the cycle.

Figure 9:
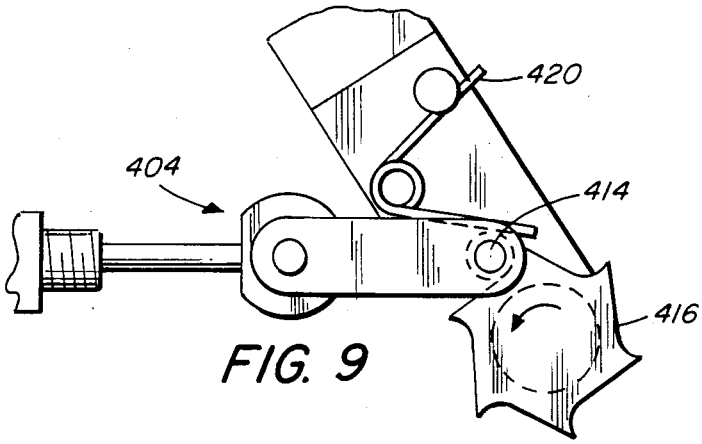
FIG. 9 is a side view of a drive mechanism used in the split ring feeder assembly.
Figure 8:
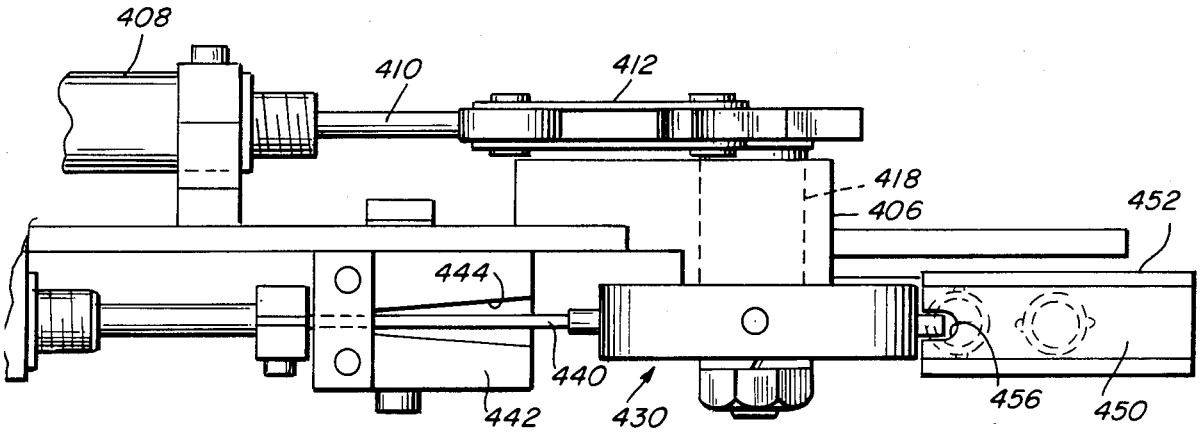
FIG. 8 is a top view of FIG. 7.
Figure 7:
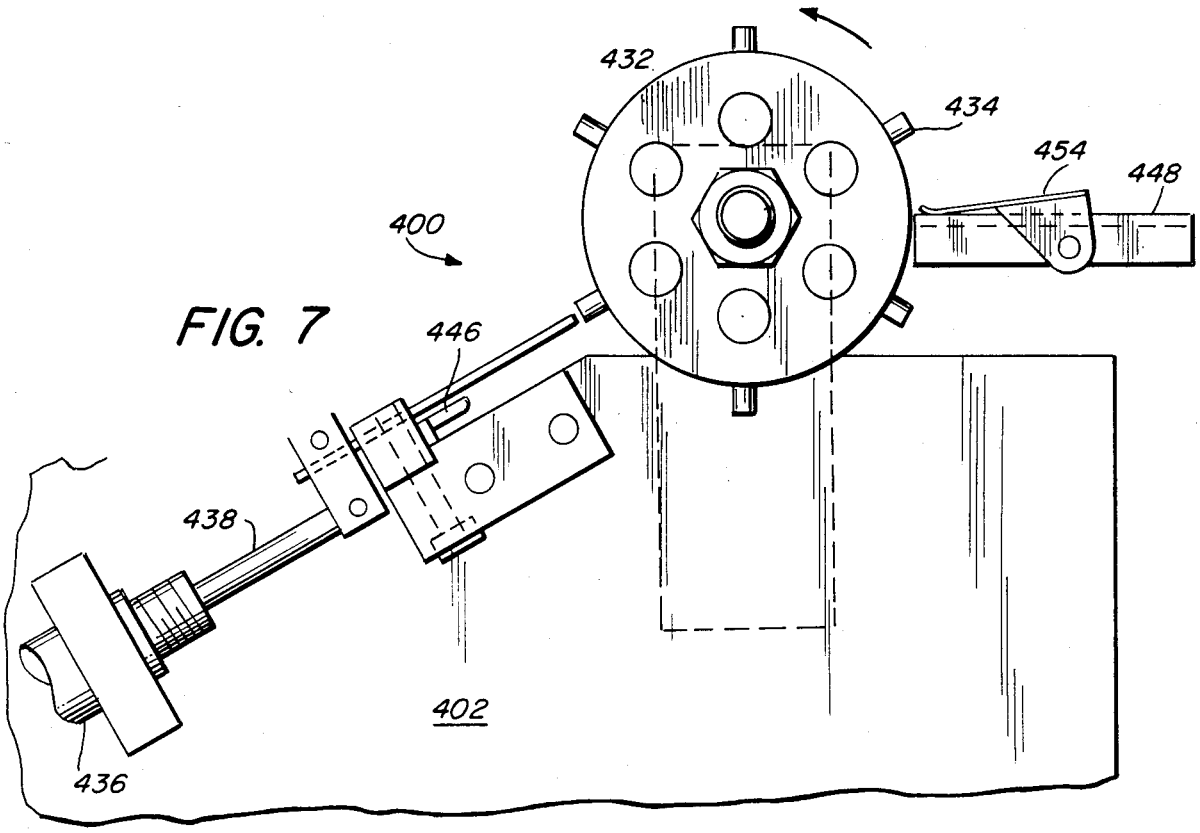
FIG. 7 is a side view of a spring ring feeder assembly.

A spring ring feeder 400 is shown in FIGS. 7, 8 and 9 and comprises a base 402 to which is secured a drive assembly 404, a bearing block 406 and an index assembly 430. The drive assembly 404 includes a pneumatic cylinder 408, a ram 410 and pivot plates 412 joined at their one end to the ram. A crossbar 414 is joined to the other end of the pivot plates and drivingly engages a toothed wheel 416. The wheel is joined to a sleeve 418 which passes through the bearing block 406. A spring 420 is secured to the block 406 and engages the edge of the toothed wheel 416.

The index assembly 430 comprises an index plate 432 having extending tubes 434 which plate 432 is joined to the sleeve 418 whereby it moves with the wheel 416. A pneumatic cylinder 436 with a ram 438 is joined to a transfer pin 440. A guide block 442 includes a Y-shaped channel 444 having an alignment pin 446 at its base. The pin 440 passes through the channel.

A trough 448 has a floor 450 and walls 452. A gate 454 is pinned to the walls 452 and the floor 450 is characterized by an opening 456 at the discharge end thereof.

In the operation of the feeder 400, spring rings are fed from a vibration bowl feeder into the trough and travel down the trough 448. The gate 454 ensures that they reach the end of the trough in a flat position one at a time. The cylinder 408 is actuated, the crossbar 404 drives an engaged tooth until the tooth passes the one end of the spring 420 which deflects downwardly holding the wheel 416 in place. The cylinder 408 retracts the crossbar 404 drawing it downwardly across the cammed surface of the toothed wheel until it engages the next succeeding tooth. This process is repeated. The index plate 432 moves with the wheel 416 and the tab 434 passes through the opening of the trough engaging a spring ring. The spring ring is carried until it is received by the transfer pin 440 to which it is transfered by gravity. The ring slides down the pin 440 with the bail and the latch in a depending position (because of gravity). When the spring ring comes to rest, the bail will be on one side of the alignment pin and the latch on the other. A photosensor (not shown) determines which side of the alignment pin the bail of the spring ring is and based on this information the robot gripper acquires the spring ring and proceeds according to step 38 of Chain Finishing Procedures with cap or step 42 of Chain Finishing Procedures with D-ring. After the ring has been gripped by the robot gripper, the transfer pin 440 is retracted by cylinder 436 a sufficient distance to allow the gripped spring ring to be removed. Subsequently, the transfer pin is extended to the position shown in FIG. 8.

Figure 10B:
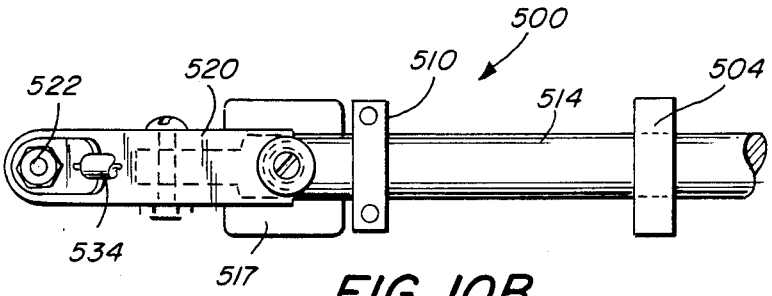
FIGS. 10*a* and 10*b* are front and top views of a welding arm.
Figure 10A:
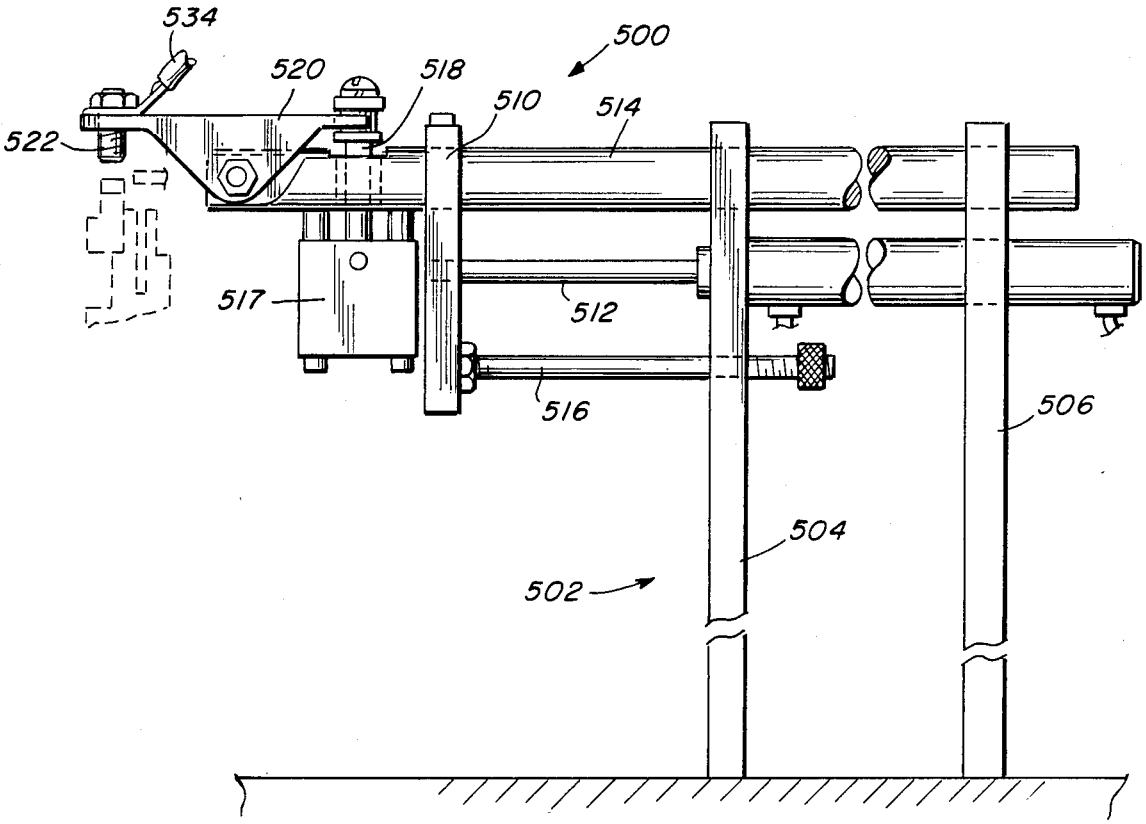

Referring to FIGS. 10*a* and 10*b*, a welding arm is shown generally at 500 and comprises a frame 502 that is bolted to the table. The frame has parallel spaced apart support plates 504 and 506. A pneumatic cylinder 508 is secured to the plates 504 and 506. A stop bar 510 is joined to one end of the ram 512 of the cylinder 508. Joined to the stop bar 510 and slidably received in the plates 504 and 506 are a shaft 514 and a rod 516. Secured to one end of the shaft 514 is a pneumatic cylinder 517 with its associated ram 518. A rocker arm 520 is pinned to the end of the shaft, one end of the rocker arm joined to the ram 518 and the other end having a weld post 522 with an associated terminal 534 joined thereto. The cylinder 508 effects movement of the rocker arm toward and away from the soldering platform; specifically the cylinder 517 moves the weld post 522 into and out of engagement with a corresponding weld post 548 (see FIG. 11*b*) at the soldering platform.

Figure 11A:
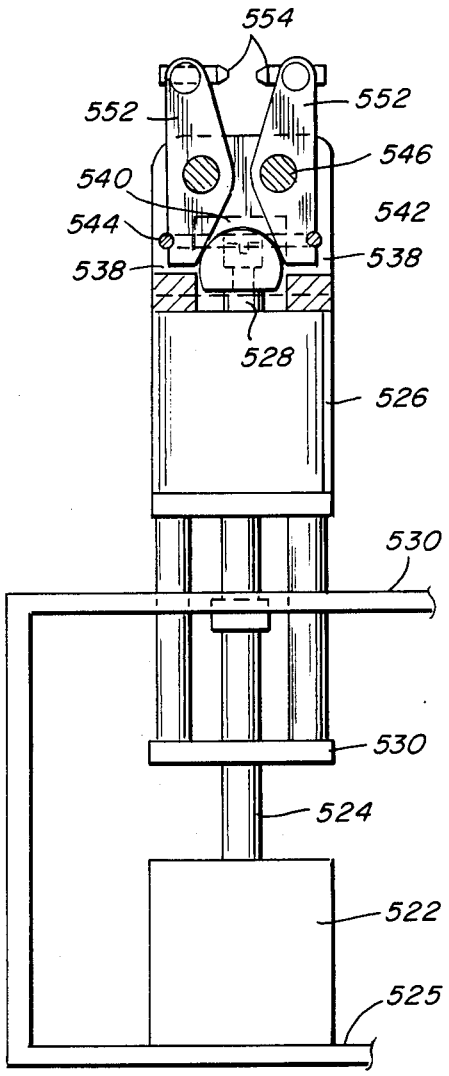
FIGS. 11*a* and 11*b* are front and side views of the soldering platform with tweezers for securing the end caps.
Figure 11B:
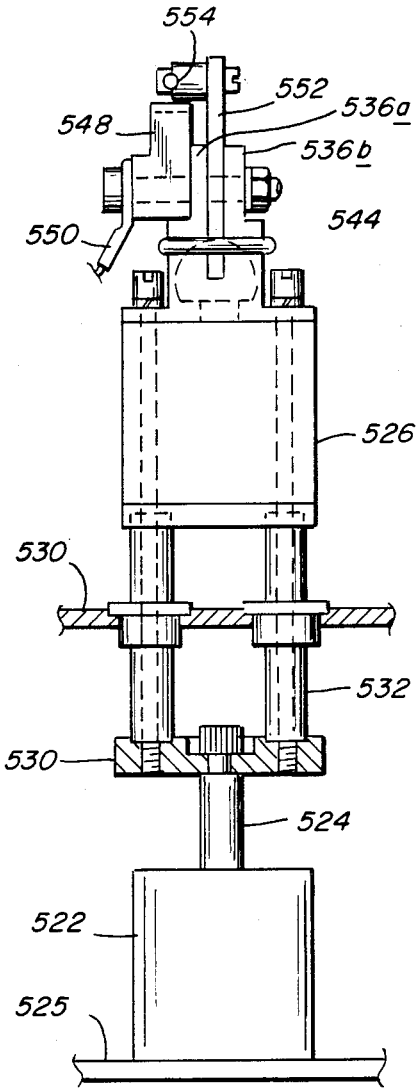

Referring to FIGS. 11*a* and 11*b*, the soldering platform is shown at 520. The platform 520 comprises a cylinder 522 having a ram 524 which cylinder is secured to a bottom plate 525 of the platform as shown. A second cylinder 526 is disposed above the plate 525 and includes an associated ram 528. Secured to the ram 524 is a top plate 530 to which is joined a post 532 which slidably passes through the plate 530. The post 532 is secured to the bottom of the cylinder 526.

Secured to the top of the cylinder 526 are paired mounting blocks 536*a* and 536*b* each block having legs 538 which legs define a chamber 540. The paired mounting blocks are characterized by a groove 542 in which is received an O-ring 544. Paired holes 546 are formed in the mounting blocks 536. A weld post 548 is secured to mounting block 536*a* by a stud passing through the weld post through mounting block 536*a* and being secured on the other side of the mounting block 536*b*. The weld post includes a terminal 550. A recess 551 is formed in the top surface of the post 548. The end cap (or D-ring) is placed in the recess. The end of the chain carried by the clamp (200*a* or 200*b*) is inserted into the end cap (or abutts the D-ring) and is held by the clamp during welding.

In the preferred embodiment of the invention wherein the platform is used for soldering end caps, jaws 552 having aligmment pins 554 joined thereto are secured between the mounting blocks 536*a* and 536*b* and are adapted for oscillatory motion about the axis of the studs. The movement of the ram 528 causes the jaws which are in a normally open position at their upper ends to be drawn toward one another thereby centering and securing the chain between the alignment pins.

Figure 12:
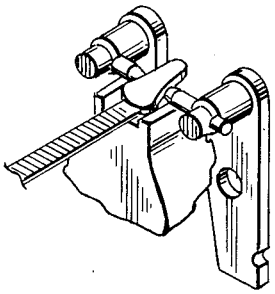
FIG. 12 is a perspective view of an end-cap chain at the soldering platform.

The welding arm—soldering platform—end cap—chain end relationship are shown in FIG. 12.

Figure 13:
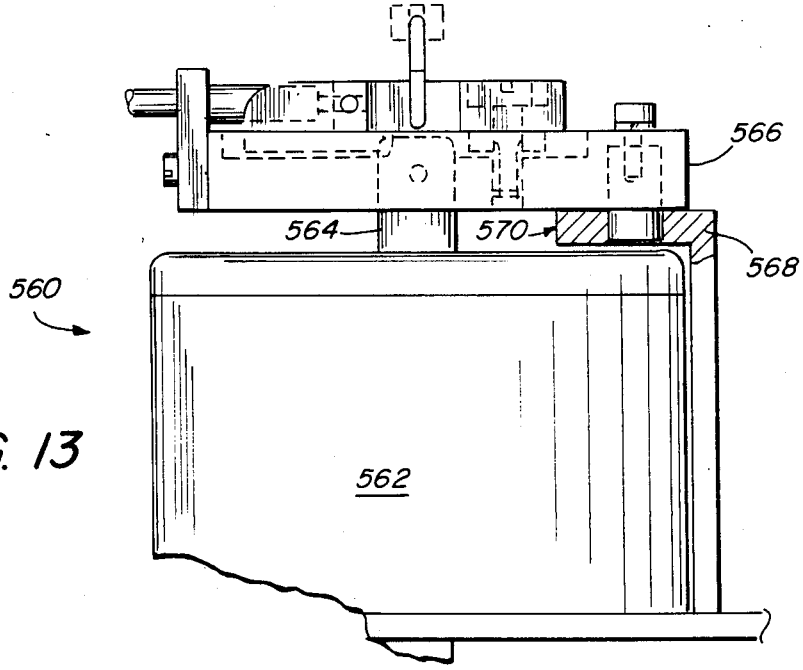
FIG. 13 is a front view of a ring twisting station.

Referring to FIG. 13, the ring twisting station is generally shown at 560. The station may be used to open and close D-rings, the bails of the spring rings and other 'fasteners' which require that they be opened and subsequently closed in any chain assembly.

Figure 15A:
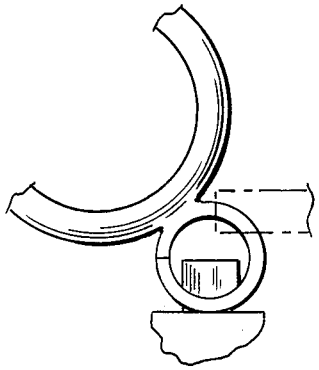
FIG. 15*b* is a perspective view of a ring opened and 15*a* illustrates a fastener inserted in the ring twisting station.
Figure 15B:
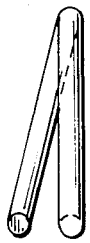

The ring twisting station comprises a base 562 within which is a rotary solenoid (not shown) which rotates a shaft 564 to which a plate 566 is attached. The plate 566 can rotate by an amount limited by slot 572 which is machined on the short leg of an L-shaped plate 568. Rings are secured between plates 576 and 578 when a cylinder 580 extends to translate plate 576. An adjustment screw 582 allows for different size rings to be opened and closed. In operation of the ring twisting station, the robot gripper moves the ring to be opened to between the facing surfaces of the anchor plates. The anchor plate 576 moves to a closed position and the plate 566 rotates in the direction as commanded to open and/or close the ring dependng upon the operation. During twisting the robot gripper holds the fastener specifically at the bail of the spring ring shown in FIG. 15*a*. The bail is shown opened in FIG. 15*b*.

The preferred embodiment will be described with reference to the assembly of a semi-flexible chain, commonly referred to as a swedge chain or a fashion chain. The chain will have attached to its ends, end caps which in turn will be joined to a spring ring and the complete chain assembly will be assembled to form a close loop and be placed over a rod or the like. As is known, these end caps are tinned. In connection with the preferred embodiment the programmed operations of end cap feeder, spring ring feeder, resistance soldering, spring ring opening to engage with the end cap, the robot gripper, the shearing station and the grippers will be described in detail. It is to be understood that this specific sequence of steps is merely illustrative and not intended to be limiting.

Operation

The robot used in the preferred embodiment of the invention is an MR-03 robot available from Microbo Corporation. Control of the CPU of the robot is accomplished through instructions which are written in terms of the particular mode of operation desired. The computer thus has stored in its memory and disks the programs and routines corresponding to each mode of operation of the computer. It is well known to those skilled in the art that the computer comprises suitable control, storage and computational units for performing arithmetic and logical functions on data which it processes in ditigal form. Any standard computer language consistent with the capability of the computer can be used with the instructions. The subroutines are not described in detail since they can be written in any desired notations, formats or sequence depending upon the particular computer being utilized, computer language, etc.

The main programs used are put in terms of structural flow below. The manufacturers handbook sets forth the necessary programs which include the sequence of internal interconnections which have been added by preparation and loading of the programs into the internal memory of the computer.

The computer used in the preferred embodiment has control boards to control eleven dc motors. Five of these boards are used to control the robot arm through its five degrees of freedom. Four of the boards are used to drive the motors in the gripper assemblies and one board is used to drive the soldering paste apparatus. The CPU includes ports to provide outputs to control fifteen pneumatic cylinders. These are for the grippers (four total), two pneumatic cylinders which control the support plate, one for the torch, one for paste applicator, one for the welding arm, two for the shearing station, two for the spring ring feeder, one for the end cap feeder and one for the ring twisting operations.

The general acquisition of an object, such as the spring ring, quality tag, end cap and/or D-ring and its movement from an acquisition site to a work site is known in the art. Here the object is acquired at an acquisition site and lies in a known plane and is at a known orientation. The object thus acquired is transported to the work site as hereinafter described. The handling consists of transforming the orientation of the fastener from one known state to another known state by an orientation mechanism. More specifically, during set up, the robot gripper is moved to acquire an object, move the object and release the object via a keyboard controlled by an operator. This is done for each task (acquisition, movement and release) the robot will perform during a chain assembly. Subsequently, the tasks are performed automatically. Thus, the specific transfer of the fasteners and their manipulation is well within the skill of the art.

Referring to FIG. 1, the chain is threaded through the shear station manually with the chain extending slightly beyond the cut position. The cut position is defined as the location where the shearing or cutting of the chain takes place. With reference to the drawings and the following structural flow, the phrase 'immediately after the cut position' refers to that zone 'immediately to the right of the cut position' and the phrase before the cut position refers to the zone immediately to the left of the cut position.

When the chain is cut there will be some deflection of the chain to the left of the cut position (FIG. 2) and after the support plate. However, the jaws of the clamps open wide enough to accommodate the chain.

Referring to FIG. 2, a chain length of 18", which is less than the distance between the shearing station and the soldering platform, can be cut as follows: clamp 200*a* acquires the chain at position #1 to the left of cut position and pulls the chain until displacement registers 17.5", (0.5" of chain always overhangs). Clamp 200*b* is then placed at position #2 to the right of cut position to clamp the chain and then the shear is activated to cut 18" of chain. For a chain which is 36" long, longer than the distance between the shearing station and soldering platform, the following steps are followed. The clamp 200*a* acquires the chain at position #1 to the left of cut position and pulls chain until displacement registers 23.5". From the leading end of chain to cut position this is a 24" length of chain. 12" more of chain are needed which can be acquired as follows: Position clamp 200*b* at position #1 to the left of cut position and grasp and pull chain until displacement registers 11.5". This represents the required 12" of length of chain. Release the grasp of the clamp 200*b* and translate it to position #2 to the right of the cut position and grasp the chain. Activate the shear to cut chain. The total length of the cut chain is the required 36".

Thus, the apparatus can assemble chains of any length depending on the requirements. This is essentially accomplished by repeatedly moving clamp 200*b* back to the shear to pull more length of chain.

AUTOMATIC CHAIN FINISHING PROCEDURES with cap

0. Set clamps on 'open' status (clamps are open)
1. Position open clamp 200*b* at position #2 to the right of 'cut position' (FIG. 2)
   1a. Insert chain through shear station 100 manually with end of chain resting on gripper surfaces of clamp 200*b*.
2. Close clamp 200*b* at position #2 to the right of cut position (FIG. 2)
3. Actuate blades 108 and 114 to cut the chain
4. Release grasp of clamp 200*b* (clamp is opened)
5. Retract clamp 200*b* to an initial retracted position close to shear station as not to interfere with other operations
6. Translate clamp 200*a* in two directions to position it at position #1 to the left of "cut" position as shown in FIG. 2
7. Grasp chain securely with clamp 200*a*
8. Translate clamp 200*a* in two directions to position it at soldering platform whereby the end of the chain lies over the weld post 551
   Note: If the required length is shorter than the distance between cutting and assembly station, then
   1. Translate clamp 200*a* to required length
   2. Translate clamp 200*b* in two directions to the right of cut position, position #2
   3. Grasp chain securely with clamp 200*b*
   4. Shear is actuated to cut the chain
   5. Translate clamp 200*b* so that clamp 200*a* and end of chain is able to reach the weld post 548
9. Acquire an end cap 314 from the feeder 300 by the robot arm gripper
10. Move and position the cap over and under the chain and over the weld post 548—the soldering platform is raised by actuating cylinder 522, FIG. 11*b*
11. Actuate the tweezers 554, FIG. 11 to center the chain and cap by actuating cylinder 526, FIG. 11*b*
12. Retract the tweezers
13. Weld post 549 descends, contacts the end cap and soldering is performed
14. Lower soldering platform
15. Release grasp of clamp 200*a*
16. Clamp 200*a* is to grasp over the cap
17. Grasp chain and cap securely with clamp 200*a*
18. Robot gripper releases its grasp of cap
19. Robot gripper moves to acquire another cap
20. Translate clamp 200*b* to securely grasp chain at position #2 to the right of 'cut' position, FIG. 2
21. Cut required length of chain
22. Translate clamp 200*b* closer to clamp 200*a*

23. Rotate clamps 200*a* and 200*b* by 180 degrees to position leading and trailing ends of chain opposite each other
24. Maintain a working distance between clamp 200*a* and 200*b* and translate both so that clamp 200*b* is positioned at assembly station so that end of chain is over weld post 548
25. Robot gripper acquires a cap from feeder 300
26. Robot gripper moves with cap to clamp 200*b* which holds the chain over welding post 548
27. Insert cap over and under chain-welding station is raised by actuating cylinder 522, FIG. 11*b*
28. Move the tweezers 554 to center the chain and cap by actuating cylinders 526, FIG. 11*a*
29. Retract the tweezers
30. Weld post 549 descends
31. Perform resistance soldering
32. Lower welding station by actuating cylinder 522, FIG. 11*b*
33. Release grasp of clamp 200*b* while the robot gripper still holds cap securely
34. Translate clamp 200*b* over cap
35. Grasp chain and cap securely with clamp 200*b*
36. Robot arm releases its grasp of cap
37. Robot arm acquires spring ring from a feeder 400
38. Twist bail of spring ring open by inserting between locking members 576 and 578, which secure spring ring when cylinder 580 is actuated. The rotary actuator performs the opening by twisting (rotating shaft 564)
39. Robot arm moves spring ring to clamp 200*b*
40. Open bail of spring ring is inserted into cap
41. Spring ring is still held securely by the robot gripper
42. Clamp 200*b* releases its grasp on the chain which is now held by the robot gripper at the spring ring
43. Robot arm moves to insert bail between the locking members 576 and 578 in FIG. 13 which are closed and twisted closing the bail (rotating shaft 564)
44. Robot gripper carries the chain next to clamps 200*a* and 200*b*
45. Clamp 200*a* closes its fingers and moves adjacent to clamp 200*a*
46. Robot gripper translates in conjunction with clamp 200*b* in order to open the bolt of the spring ring, as the opening of the spring ring is fitted into the opening of end cap
47. Clamp 200*b* is retracted to release the bolt of spring ring which snaps closed over end cap
48. Clamp 200*a* releases grasp of chain
49. Robot gripper now holds completed chain and carries it onto a cylindrical surface
50. Translate and retract clamp 200*b* to initial retracted position
51. Go to step #7 (cycle has been completed)

In an alternative embodiment of the invention, the welding arm is removed and a paste and torch applicator are secured to the apparatus in any suitable manner such that their movement will bring them into contact with the soldering platform. Further, the blades 562 on the soldering platform are removed and the blades 558, FIG. 18 substituted therefor. The end cap feeder is removed and the D-ring feeder is substituted therefor. The quality tag feeder is secured to the apparatus. After these structural changes, the computer is re-programmed, as is well understood, to effect the sequence of steps set forth in Automatic Chain Finishing Procedures—with ring.

Figure 16A:
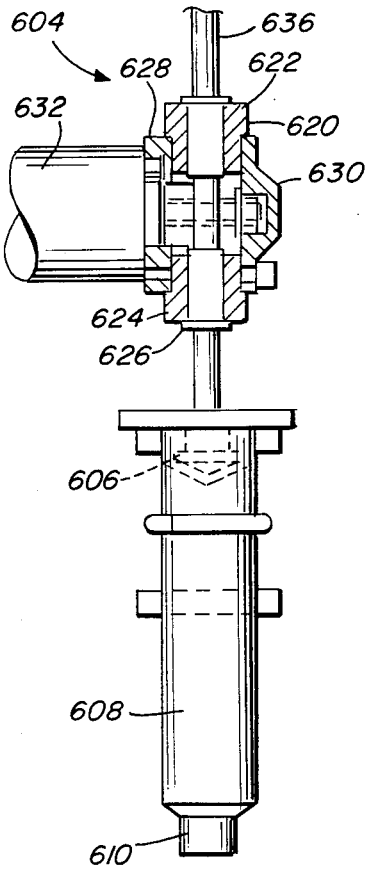
FIGS. 16*a* and 16*b* are front and side views of the paste applicator.
Figure 16B:
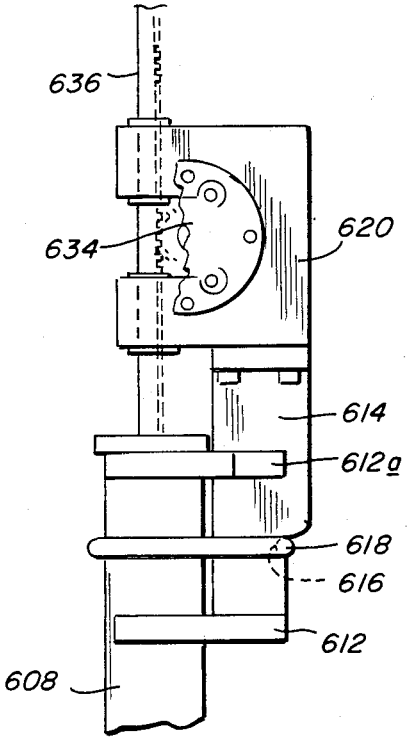

The paste applicator and torch manipulator are shown in FIGS. 16 and 17. In FIGS. 16*a* and 16*b* a paste applicator 64 is shown in detail. It comprises a syringe 608 and 606. Received in the syringe is a plunger 606 adapted for movement within a sleeve 608 the syringe being characterized by a discharge end 610. As shown more clearly in FIG. 16*b* the syringe 606 and 608 is held by two support arms 612*a* and 612*b* which are joined to a plate 614 characterized by a recess 616. An O-ring 618 is received in the recess 616 to hold the syringe 604 tightly against the supports 612. Joined to the plate 614 is an upper block 620 having an opening 622 therein joined to a lower block 624 having an opening 626 (shown most clearly in FIG. 16*a*).

On one side of the upper and lower blocks is a plate 628 and on the other side is a bearing cap 630. A motor 632 is joined to the plate 628 and a shaft carrying a pinion 634 passes between the upper and lower blocks and is journaled in the bearing cap 630. A rack 636 engages the pinion and passes through the opening 622 and 626. The pinion is driven by the motor 632.

Figure 18:
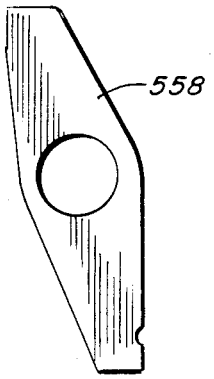
FIG. 18 is a front view of the blades used in the soldering platform for D-rings.
Figure 19:
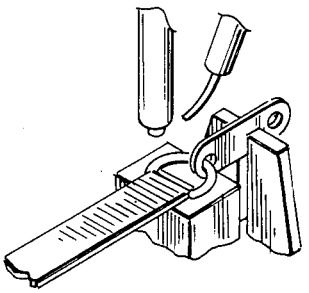
FIG. 19 is a perspective view of a chain D-ring quality tag at the soldering platform.
Figure 17A:
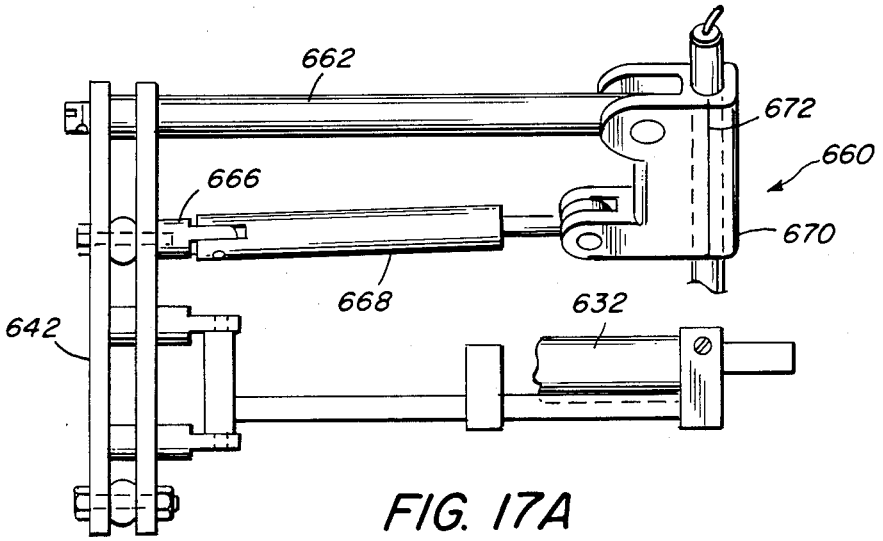
FIGS. 17*a* and 17*b* are plan and front views of a torch manipulator and partial views of the paste applicator.
Figure 17B:
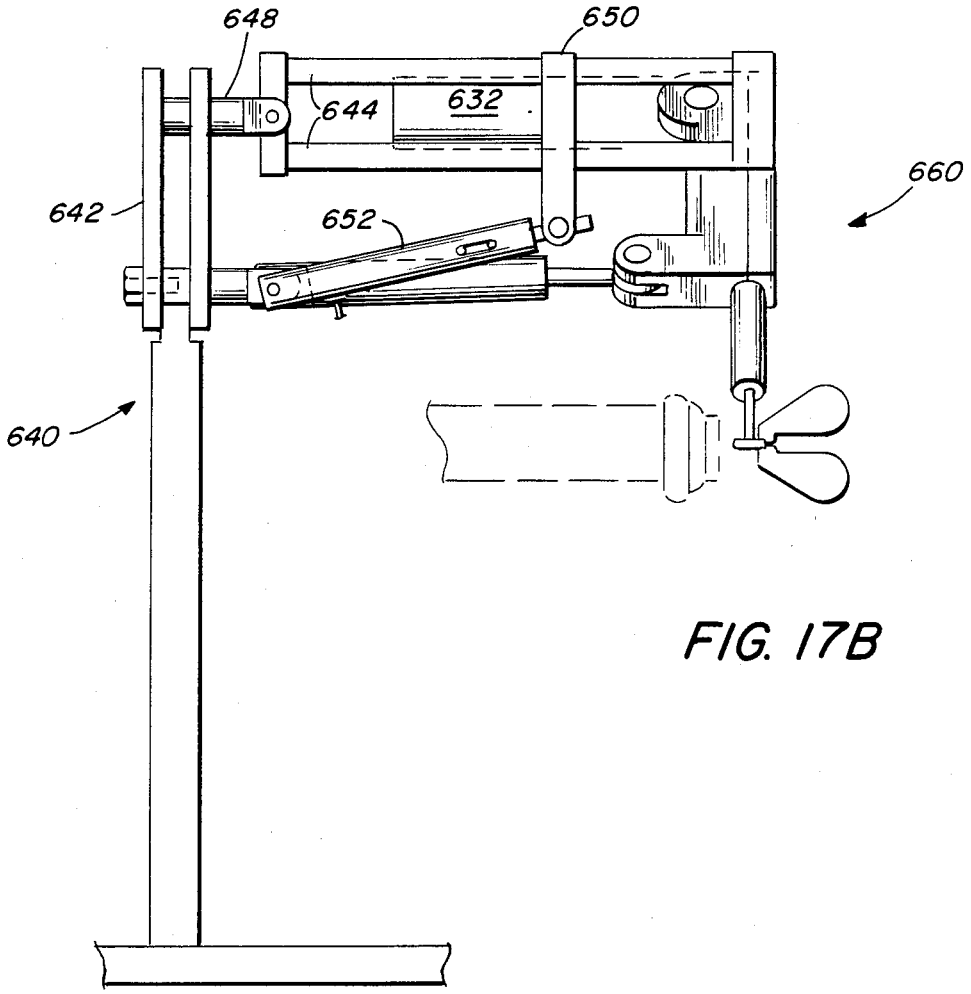

The paste applicator 604 and a torch mechanism 640 are secured to a common wall 642 as shown in FIGS. 17*a* and 17*b*. The relationship of the paste applicator 602 and torch manipulator 640 and the soldering platform are shown in FIG. 19. FIG. 18 illustrates the blades 558 used in this embodiment of the invention.

The motor 632 of the paste applicator 602 is secured to posts 644. Depending ends of the posts are secured to a cross-brace 646 which is pinned to a clevis 648. The clevis is secured to the wall 642. A strap 650 is secured to the posts. A pneumatic cylinder 652 is secured to the wall 642 and the ram of the cylinder is joined to the depending end of the strap 650. Actuation of the cylinder effects an up-down movement of the paste applicator away from and toward the soldering platform. When a D-ring and chain are abutted on the soldering platform (see FIG. 19), the pneumatic cylinder 652 is actuated drawing the paste applicator downwardly and slightly above the end of chain D-ring. The motor 632 is actuated (stepped) driving the plunger 606 downwardly thereby discharging soldering paste at the junction of the D-ring and end of chain. Subsequently, the cylinder is actuated moving the paste applicator away from the soldering platform.

The torch manipulator 660 shown in FIGS. 17*a* and 17*b* is pinned to a rod 662 which rod is joined to the wall 642. A clevis 666 is also joined to the wall 642 and spaced apart from the location where the rod 662 is joined to the wall. One end of a pneumatic cylinder 668 is joined to the clevis 666 and the ram of the cylinder is pinned to one end of a clamp 670. The other end of the clamp is pinned to the post 662.

The spine of the clamp 670 is characterized by an elongated recess 672 in which a torch is secured. Actuation of the cylinder 668 effects movement of the torch through a 45° angle from a first position where the torch is moved away from the soldering platform to a second position where the torch supplies the necessary heat to effect soldering of the D-ring to the end of the chain. This relationship is shown generally in FIG. 19. (Although described in reference to soldering and welding by conventional techniques, other techniques for securing the fasteners may be used such as adhesive systems, lasers, threaded engagement friction type fitting etc.)

Referring to FIG. 19, a quality tag feeder is shown schematically at 700 and comprises a sleeve-like track 702 (rectangular when viewed in crossection) through which quality tags 704 slide downwardly by gravity. Quality tags are fed to the track from a vibratory bowl feeder (not shown). At the discharge end of the track are retaining springs 706 which are biased toward the longitudinal axis of the track by anchor springs 708 as shown. The quality tags are acquired by the robot gripper which withdraws the exposed quality tag from the track. As the quality tag is withdrawn, the arms deflect outwardly allowing the quality tag to pass therethrough and after the tag has been removed they deflect inwardly to prevent the discharge by gravity of the next succeeding quality tag.

Figure 21:
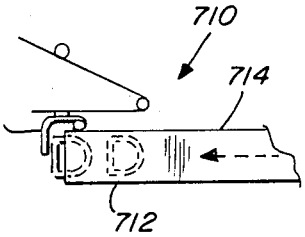
FIG. 21 is a schematic view of a D-ring feeder.

A D-ring feeder 710 is shown generally in FIG. 21. The D-rings 712 slide down a track 714 which is similar in construction to the quality tag track i.e. sleeve-like and rectangular when viewed in cross section. The D-rings slide down the track with the split side (flat side) depending. As shown, restraining springs 716 are used as with the quality tag feeder. Similar structures may be used for oval rings, lobster claws, etc. That is, it is preferred that the fasteners slide down a track by gravity and be retained at the end of the track by spring arms until acquired by the robot gripper. Where it is important that the orientation be known due to the location of a split (such as in a D-ring) or wherein the fastener may have various size openings (such as in a lobster claw) optical sensors may be used to determine the specific orientation and based on this information the robot gripper can acquire the fasteners.

AUTOMATIC CHAIN FINISHING PROCEDURES with ring

Figure 14:
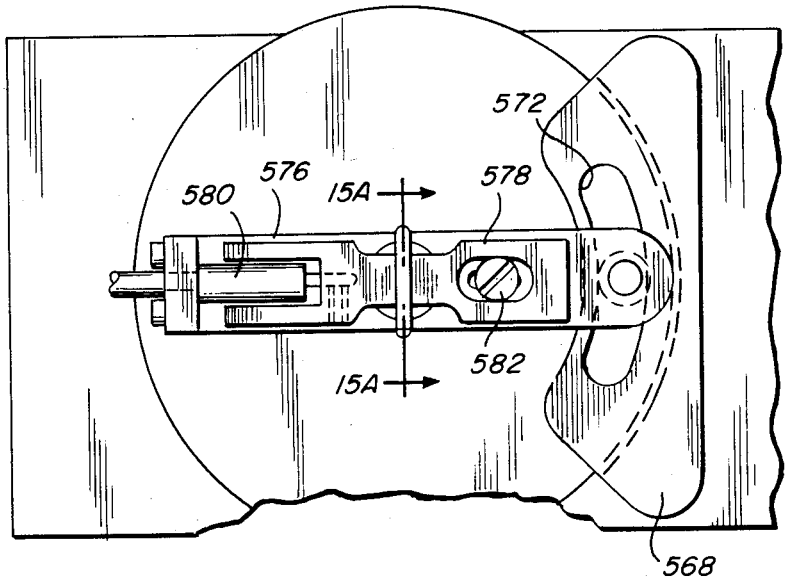
FIG. 14 is a top view of FIG. 13.
Figure 20:
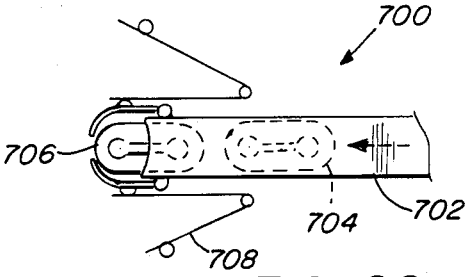
FIG. 20 is a schematic view of a quality tag feeder.

0. Set clamps on 'open' status (clamps are open)
1. Position open clamp **200*b* at position #2 to the right of 'cut position' (FIG. 2**)
   1a. Insert chain through shear station 100 manually with end of chain resting on gripper surfaces of clamp **200*b***.
2. Close clamp **200*b* at position #2 to the right of cut position (FIG. 2**)
3. Actuate blades 108 and 114 to cut the chain
4. Release grasp of clamp **200*b*** (clamp is opened)
5. Retract clamp **200*b*** to an initial retracted position close to shear station as not to interfere with other operations
6. Translate clamp **200*a* in two directions to position it at position #1 to the left of "cut" position as shown in FIG. 2**
7. Grasp chain securely with clamp **200*a***
8. Translate clamp **200*a* in two directions to position it at soldering platform whereby the end of the chain lies over the weld post 548**
   Note: If the required length is shorter than the distance between cutting and assembly station, then
   1. Translate clamp **200*a*** to required length
   2. Translate clamp **200*b*** in two directions to the right of cut position, position #2
   3. Grasp chain securely with clamp **200*b***
   4. Shear is actuated to cut the chain
   5. Translate clamp **200*b* so that clamp 200*a* and end of chain is able to reach the weld post 548**
9. Extend soldering station under the chain by actuating cylinder 522 in FIG. **11*b***
10. Apply solder paste to end of chain via the solder paste dispensing device 604
11. Acquire a D-ring from the feeder, FIG. 21, by a robot gripper
12. Move the chain and position it appropriately next to chain on soldering post 548
13. Robot gripper continues its grasp on D-ring while soldering occurs
14. Lower torch 660 by actuating cylinder 668 in FIG. **17*a*** to the soldering station
15. Torch 660 performs soldering of D-ring and chain by repeatedly actuating cylinder 668 two to three times as necessary and finally retracting torch 660 away from soldering station
16. Lower soldering post 548 from under the chain by actuating cylinder 522, FIG. **11*b***
17. Release grasp of clamp **200*a*** while chain is still grasped by robot gripper
18. Translate clamp **200*a*** closer to D-ring
19. Grasp chain securely with clamp **200*a***
20. Robot gripper releases its grasp of D-ring
21. Robot arm moves to acquire D-ring from D-ring feeder FIG. 21
22. Translate clamp **200*b* to securely grasp chain at position #2, FIG. 2**
23. Cut chain by actuating shear cylinders
24. Translate clamp **200*b* closer to clamp 200*a***
25. Rotate clamps **200*a* and 200*b*** by 180 degrees to position leading and trailing ends of chain opposite each other
26. Maintain some prespecified distance between clamps **200*a* and 200*b* and translate both so that clamp 200*b* is positioned over soldering post 548**
27. Extend soldering station under chain by actuating cylinder 522, FIG. **11*b***
28. Apply solder paste to end of chain via solder paste dispensing device
29. Acquire a D-ring and open by inserting between locking members 576 and 578, FIGS. 13 and 14 (Step 38 of Cap Procedures)
30. Move the D-ring to quality tag feeder, FIG. 20
31. Insert the D-ring into quality tag
32. Close the D-ring by reversing the procedure in Step 30 above
33. While the D-ring is held rigidly in the slot the robot gripper releases its grasp
34. The robot gripper regrasps the D-ring so that the plane of quality tag is perpendicular to the plane of the ring
35. The D-ring and quality tag assembly are positioned next to chain with straight side of D-ring against the end of chain
36. Grasp quality tag by tweezers 554 on soldering station
37. Robot gripper release grasp on D-ring and quality tag assembly and moves to pick up spring-ring from spring ring feeder
38. Perform soldering between D-ring and chain as in Steps 15 and 16
39. Robot arm acquires spring ring from a spring ring feeder 400
40. Bail of spring ring is twisted open by inserting between locking members 576 and 578, FIGS. 13 and 14 (Step 38 of Cap Procedures)
41. Robot arm moves spring ring to clamp **200*b* and quality tag is still grasped by tweezer 554** at soldering station
42. Open bail is inserted into quality tag
43. Spring ring is still held securely by the robot gripper 44. Clamp **200*b* releases its grasp on the chain which is now held by the robot gripper at the spring ring and tweezers 554** at quality tag
45. Open tweezers 554 and lower soldering station
46. The robot gripper moves to insert open bail between locking members 576 and 578, FIGS. 13 and 14 (Step 38 of Cap Procedures)
47. Robot gripper moves close to clamp **200*a* and 200*b***
48. Clamp **200*b* closes its fingers and moves adjacent to clamp 200*a***
49. Robot gripper translates in conjunction with clamp **200*b*** in order to open the bolt of the spring ring, as the opening of the spring ring is fitted into the opening of D-ring
50. Clamp **200*b*** is retracted to release the bolt of spring ring which snaps closed over end cap
51. Clamp **200*a*** releases grasp of chain
52. Completed chain is now held by robot arm 600
53. Robot arm carries the chain assembly onto a cylindrical surface
54. Translate and retract clamp **200*b*** to initial position
55. Go to step #7 (cycle has been completed)

Having described our invention, what we now claim is:

1. An apparatus for securing fasteners to the ends of a chain or strand which comprises:

(a) a housing having one end and another end;

(b) a first gripper assembly moveably joined to the housing to engage one end of the chain and a second gripper assembly moveably joined to the housing to engage the chain;

(c) the gripper assemblies each including means to move said assemblies through at least three degrees of freedom, two in translation and one in rotation, one of the degrees of movement in translation being from the one end of the housing to the other end;

(d) a shearing station to sever the chain disposed at the one end of the housing, the chain when severed forming another end held by the second gripper assembly;

(e) a robot gripper disposed at the other end of the housing adapted to acquire a fastener;

(f) an assembly station disposed at the other end of the housing, said station including means to feed a fastener to the robot gripper and means to secure a fastener to said one end of the chain; and (g) means to control the movement of the first gripper assembly to carry the one end of the chain to the assembly station and to control the robot gripper, said means to control in communication with said gripper assemblies and the robot gripper, the means to feed the robot gripper, the robot gripper and the gripper assembly spatially arrayed at said other end of the housing whereby the robot gripper may acquire a fastener and in combination with the gripper assembly place the one end of the chain and the fastener into engagement at the assembly station where the fastener is secured to the chain.

2. The apparatus of claim 1 wherein the means to control includes:

means to control the movement of the second gripper assembly to bring the other end of the chain to the assembly station whereby a fastener may be secured to said other end of the chain.

3. The apparatus of claim 2 wherein a fastener is adapted to be opened and closed to be joined to another fastener and the assembly station includes:

means to open and close said fastener, said means to open and close in communication with the robot gripper.

4. The apparatus of claim 2 which further includes:

means at said assembly station to secure the fasteners one to the other to form a loop.

5. The apparatus of claim 4 wherein one of said fasteners is a spring ring, the robot gripper and the first gripper assembly both engage the spring ring, the second gripper assembly holds the other fastener and wherein the control means includes:

means to translate the robot gripper in conjunction with the first gripping assembly to open the bolt of the spring ring as the opening of the spring ring is fitted into an opening of the other fastener.

6. The apparatus of claim 1 wherein the gripper assemblies each include jaws having opposed planar facing surfaces and which includes means to move the surfaces in parallel relationship.

7. The apparatus of claim 6 wherein the housing is longitudinal and the gripper assemblies include:

means to move the jaws in a direction orthogonal to the longitudinal axis of the housing.

8. The apparatus of claim 7 which further includes:

means on said gripper assemblies to rotate the jaws.

9. The apparatus of claim 7 wherein the housing includes:

paired rails on either side of the gripper assemblies, each include tracks which engage the rails whereby the gripper assemblies may move from one end of the housing to the other.

10. The apparatus of claim 7 wherein the shearing station includes:

means to cut the chain intermediate the ends of the rails.

11. The apparatus of claim 1 wherein the means to secure the fasteners comprises:

a soldering platform adapted to move from a lower to an upper supporting position; and means to solder the end of the chain to the fastener.

12. The apparatus of claim 1 wherein the means to feed comprises:

means to feed a quality tag, said means to feed in communication with the robot gripper.

13. The apparatus of claim 1 wherein the means to feed comprises:

means to feed a spring ring said means to feed in communication with the robot gripper.

14. The apparatus of claim 13 wherein the means to feed the spring ring includes:

means to orient the spring ring whereby the positions of the bail and the bolt are established.

15. The apparatus of claim 1 wherein the means to feed comprises:

means to feed an end cap, the robot gripper in acquiring relationship with said means.

16. The apparatus of claim 1 wherein the means to feed comprises:

means to feed a D-cap, the robot gripper in acquiring relationship with said means to feed.

* * * * *